United States Patent [19]

Fosseen

[11] Patent Number: 4,979,752

[45] Date of Patent: Dec. 25, 1990

[54] TARGET RANGE APPARATUS

[76] Inventor: Dwayne Fosseen, R.R. 1, Radcliffe, Iowa 50230

[21] Appl. No.: 518,188

[22] Filed: May 3, 1990

[51] Int. Cl.[5] ..... F41J 7/04

[52] U.S. Cl. ..... 273/392

[58] Field of Search ..... 273/390, 391, 392, 374, 273/375, 376, 378, 383, 384, 386, 387

[56] References Cited

U.S. PATENT DOCUMENTS

| | | | |
|---|---|---|---|
| 1,640,954 | 8/1927 | Mach | 273/392 X |
| 3,064,976 | 11/1962 | Kuhn | 273/391 X |
| 4,239,234 | 12/1980 | Ward | 273/391 |
| 4,397,468 | 8/1983 | D'Andrade et al. | 273/390 X |
| 4,540,182 | 9/1985 | Clement | 273/392 |

*Primary Examiner*—William H. Grieb

*Attorney, Agent, or Firm*—Kent A. Herink

[57] ABSTRACT

A target apparatus having a knock-down target supported on a target base moveable on a support frame between an upper, exposed position and a lower, hidden position. The target is pivotally attached to the target frame for movement between an upright position and a knock-down position. An air cylinder moves the target base upwardly against a pair of springs which, when the air cylinder is disabled, return the target base to the lower position. A reed switch senses movement of the target to the knock-down position and disables the air cylinder. Upon movement of the target base to the lower position, a reset arm returns the target to its upright position.

8 Claims, 3 Drawing Sheets

10
12
16
18
20
22
26
28
30
34
40
46
52
54
56
58
59
60

TARGET RANGE APPARATUS

BACKGROUND OF THE INVENTION

The invention relates generally to target range apparatus and, more specifically, to a resettable target apparatus that can be controlled from a remote location.

Typical range targets are perforated by bullets from the target guns being used and so are useful only for a small number of shots. Other, knock-down, targets are useful only for a single shot and must typically be manually reset. There is a need for rifle and handgun targets and target ranges that are both durable and reliable and capable of being set at the will of the marksman. There is also a need for target ranges having a plurality of individual targets controlled from a central location to provide a wide variety of targets and target sequences for the marksman and which will automatically score the marksman's performance.

SUMMARY OF THE INVENTION

The invention consists of a rifle or handgun target apparatus of the knock-down type which is raised by compressed air and automatically lowers and resets upon being knocked down by a marksman. A target is pivotally attached at its lower end portion to a target base that is moveable up and down on a pair of side rails which form part of the stationary supporting frame. An air cylinder interconnects the target base with a frame base so that when compressed air is directed to the cylinder, the target base will be raised to its upper position. A pair of springs also interconnect the target base and the frame base and serve to lower the target base to its lower position when compressed air is not directed to the cylinder. Valve means are provided for controlling the compressed air.

The target frame is mounted in the ground so that, in the upper position of the target base, the target is exposed above the ground. If the target is accurately hit by a marksman, it pivots backwardly about the target base to be substantially horizontal. The valve means acts to interrupt the compressed air and the springs retract the target base. As the target base retracts, the target is reset on the target base and is pulled below ground.

A plurality of the target apparatus are arranged in a target range and each is connected to a personal computer which, together with the valve means, controls the timing and sequence of the individual targets and records the score of the marksman.

DETAILED DESCRIPTION OF A PREFERRED EMBODIMENT

Figure 1:
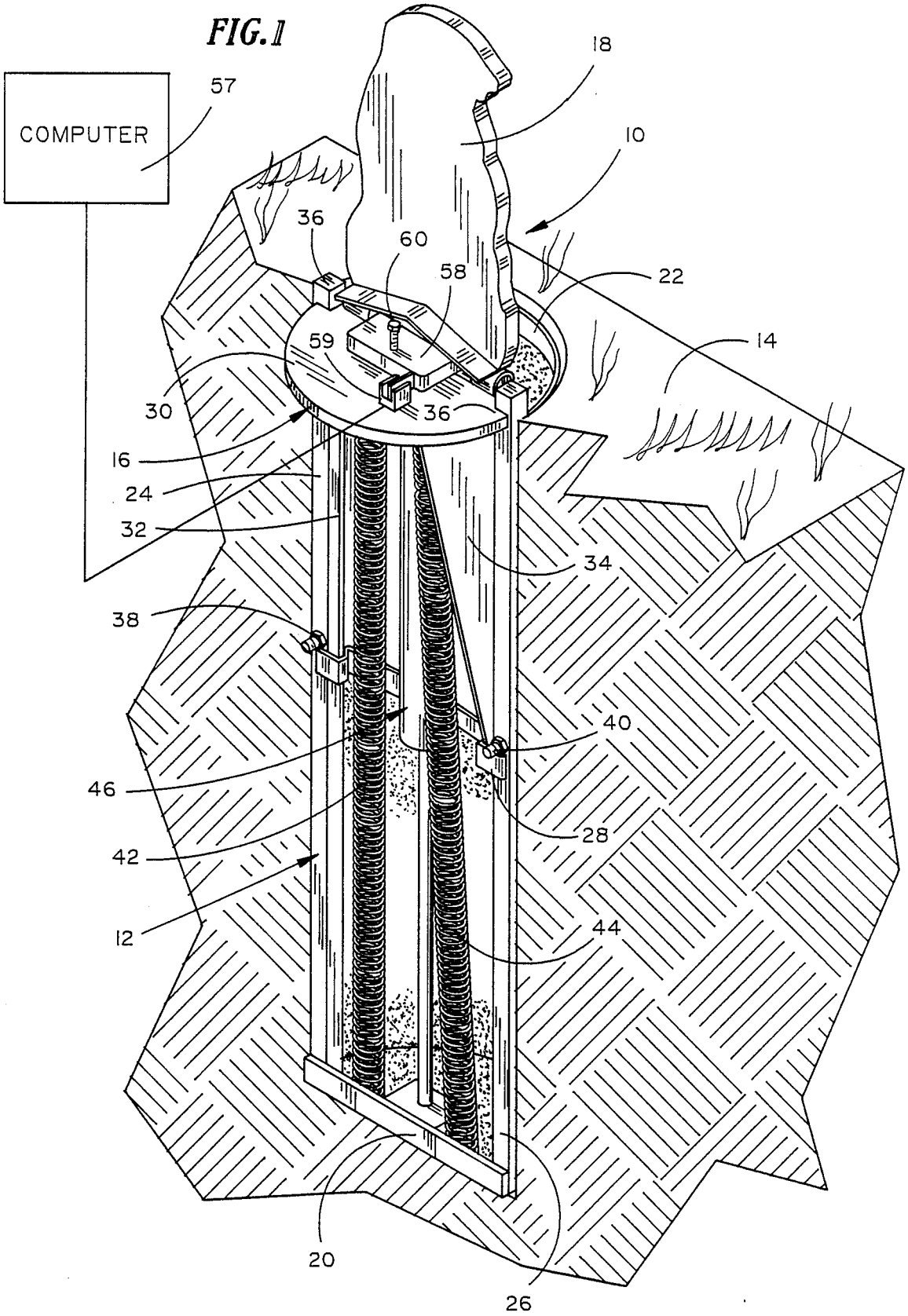
FIG. 1 is a perspective view of the target apparatus of the present invention showing the support frame thereof embedded in the ground and the target exposed above the ground.
Figure 2:
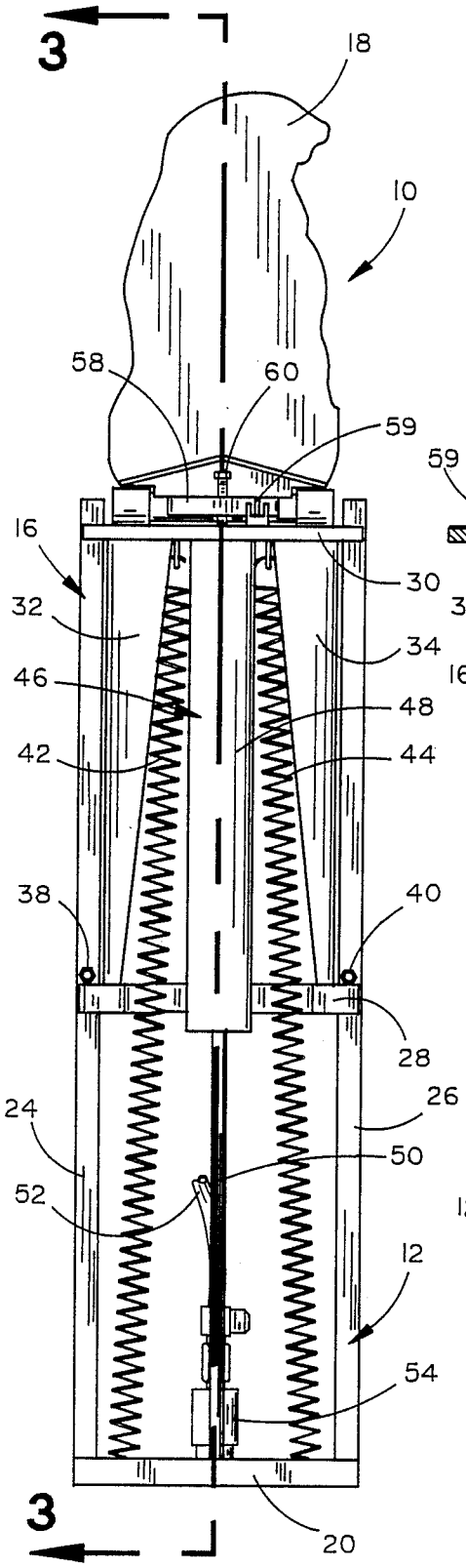
FIG. 2 is a front elevational view of the target in its upper position.
Figure 3:
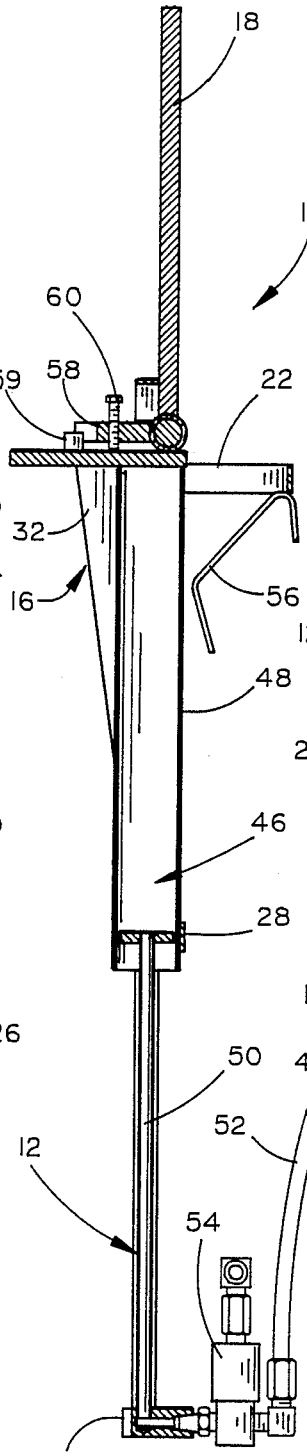
FIG. 3 is a cross-sectional view of the target apparatus taken along the line 3—3 of FIG. 2.
Figure 4:
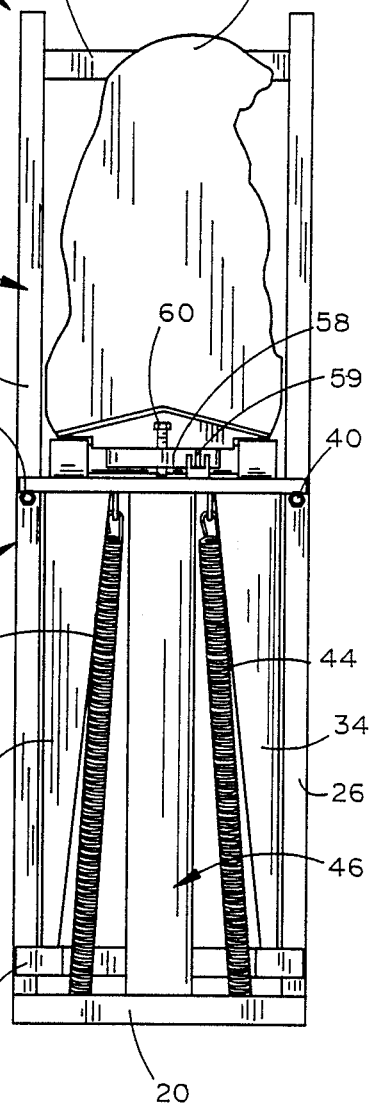
FIG. 4 is a front elevational view of the target apparatus in its lower position.

Illustrated in FIG. 1, generally at 10, is a target apparatus of the present invention. The apparatus 10 includes a support frame 12 embedded in the ground 14 and a target base 16 on which is pivotally mounted a target 18 that in the preferred embodiment is an animal silhouette. The target base 16 is mounted for vertical movement on the support frame 12 for movement of the target 18 between an exposed position (FIGS. 1–3) and a retracted or unexposed position (FIG. 4).

The support frame 12 includes a frame base 20, a hoop brace 22 and a pair of side rails 24 and 26 interconnected therebetween by weldments or other suitable means. The target base 16 includes bottom slide member 28 and a semicircular top base 30 which are interconnected by a pair of triangular braces 32 and 34. Each end portion of the slide member 18 is folded or formed to be received in sliding engagement about a corresponding one of the side rails 24 and 26 (FIG. 1). The top base 30 also is notched at 36 on either side thereof to receive in sliding engagement therein the side rails 24 and 26. The target base 16 is thus constrained to move vertically along the side rails 24 and 26.

The upper and lower limit positions of the target base 16 are determined by a pair of nut and bolt assemblies 38 and 40 attached at about the midpoint of the side rails 24 and 26. The upper position of the target base 16 is defined by contact of the slide member 28 with the bolts 38 and 40 (FIGS. 1 and 2) and the lower position by contact of the top base 30 therewith (FIG. 4).

The target base 16 is urged toward its lower position by a pair of coil springs 42 and 44 that are interconnected between the top brace 30 and the frame base 20. The target base 16 is moved upwardly by an air cylinder 46, including a body member 48 attached to the top base 30 and an extensible and retractable piston arm 50 that is attached to the frame base 20. Compressed air is supplied to the air cylinder 46 from a reservoir (not shown) via supply line 52 and electrically actuated valve 54 (FIG. 3). When the valve 54 is open, compressed air present in the supply line 52 is directed into the body member 48 of the air cylinder 46. If the pressure of the air is great enough to overcome the springs 42 and 44, the weight, and the frictional forces, the piston arm 50 will extend and force the target base 16 upwardly until the slide member 28 comes into contact with the bolts 38 and 40. If the valve 54 is turned off, air in the air cylinder 48 will be vented to atmosphere and the springs 42 and 44 will move the target base 16 downwardly to its lower position. A magnetic reed switch 59 is mounted on the target base 16 and is tripped when the target 18 is knocked over to its horizontal position. Tripping of the reed switch will act to turn off the valve 54 such that the target base 16 is moved to its lower position.

Figures 5, 6, 7, 8:
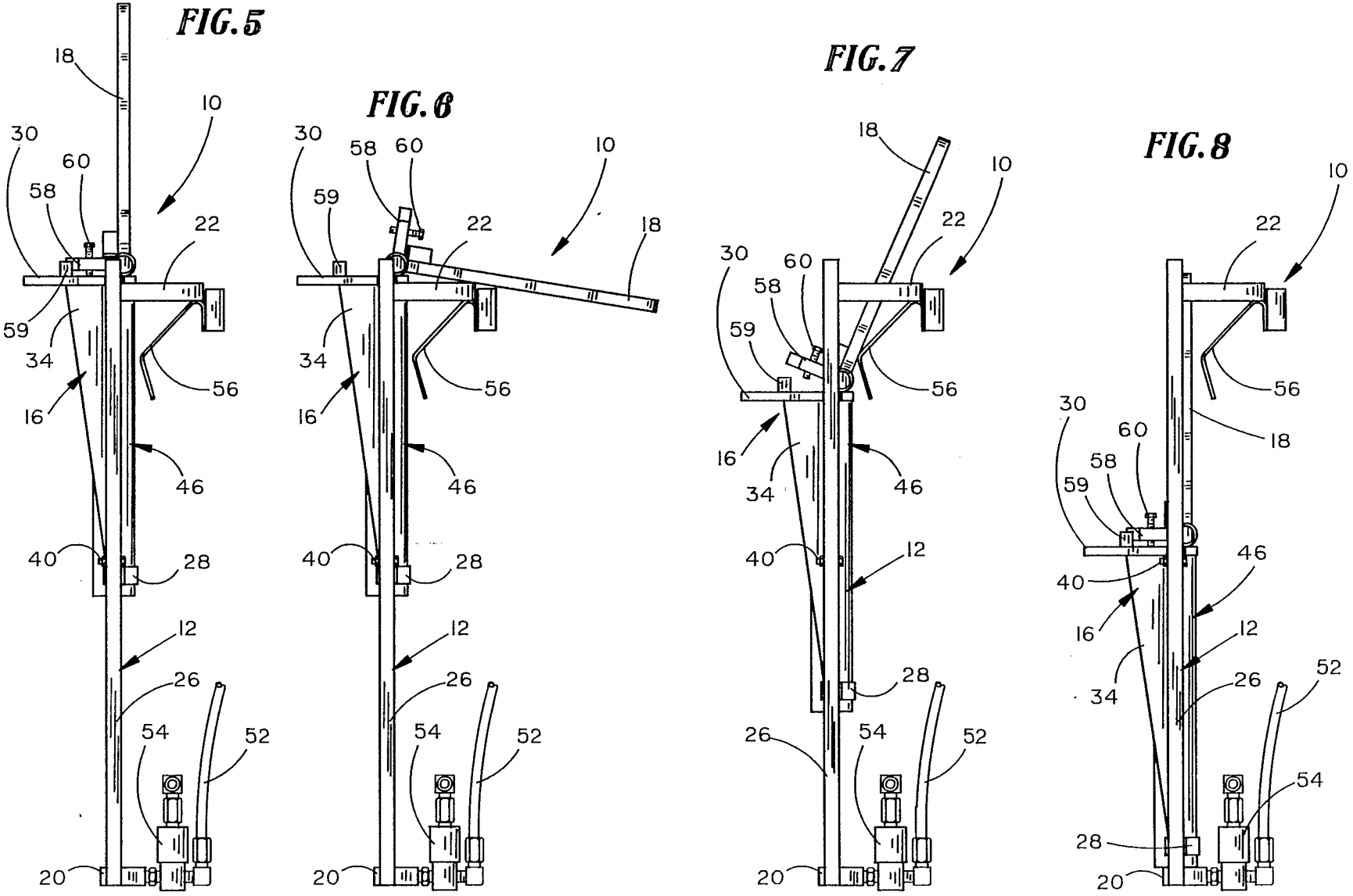
FIG. 5–8 are schematic views showing the knock-down and resetting of the target.

In use, the apparatus 10 is inserted in a hole in the ground of a sufficient size and depth to permit free movement of the target base 16 and to place the top base 30 approximately level with the surface of the ground (FIG. 1). A person using the range in which the apparatus 10 is located will cause the valve 54 to be turned on to direct compressed air into the cylinder 46 to raise the target 18 to its upper position (FIG. 5). Upon accurate contact of the target 18 by a bullet, the target 18 will be knocked down to its horizontal position (FIG. 6). The reed switch will cause the valve 54 to be turned off so that the air in the cylinder 46 is vented to atmosphere whereupon the target base 16 will be moved downwardly (FIG. 7). As the target base 16 moves downwardly, the target 18 will come into contact with a reset arm 56. The innermost projection of the reset arm 56 is close to the metastable upright plane of the target 18. The reset arm 56, accordingly acts to return the knocked down target 18 (FIG. 6) to its reset or upright position (FIG. 8). Upon activation of the valve 54, the target base 16 will be moved vertically to the exposed position (FIG. 5) ready to be reused as a target.

Extended forwardly from the lower portion of the target 18 is a prop member 58 which receives a bolt 60 which projects below the bottom surface of the prop member 58. The lower end of the bolt 60 rests atop the top base 30 when the target 18 is in its upright position and thus serves to prop up the target 18. By rotation of the bolt 60, the target 18 can be tipped relatively forwardly or rearwardly making it either harder or easier, respectively, to be knocked down by a bullet. In this way, the apparatus 10 is adjustable for use with variety of calibers and powers of ammunition as well as skill levels of marksmen.

In the preferred embodiment, a plurality of apparatus 10 are positioned in a target range at a variety of selected distances and locations. Each apparatus is connected to a computer 57 (FIG. 1) which can be programmed to select a pattern of such target apparatus to be exposed, the duration of exposure, the sequence of apparatus exposed, the scores or "hits" by the marksman, and so on. For example, a rather routine arrangement would be to set a plurality of target apparatus in a line a fixed distance from the marksman. The computer could be programmed to raise the target of the apparatus in a sequential order from left to right wherein each target is raised for, say, three seconds, and there is a one second interval between succeeding apparatus. If any of the targets are knocked down, the computer will record it as a hit and keep track of the number of hits or the score of the a marksman. Of course, an infinite number of variations of placement, interval, duration, number of targets exposed at one time, and so on can be selected and then implemented with the present invention, the programming and connection of the computer to the apparatus being a matter within the ordinary skill in the art.

Another capability of the computer is in the handicapping of marksman. Each marksman who uses the range would be identified to the computer which would then maintain a file of past performances. In a matched competition between marksmen of disparate abilities, the computer would use the record of past performances of each to adjust the target exposure duration, number of targets simultaneously exposed, or sequence of targets exposed, or all of them, so that the raw scores of each marksman would be the basis for fair comparison.

I claim:

1. A target apparatus, comprising:

(a) a support frame;

(b) a target base mounted on said support frame for vertical movement between an upper position and a lower position;

(c) means for moving said target base between said upper and lower positions;

(d) a knock-down target attached to said target base and moveable between an upright position and a knocked-down position when said target base is in said upper position;

(e) control means responsive to said knocked-down position of said target to cause movement of said target base from said upper position to said lower position; and (f) reset means for moving said target from said knocked-down position to said upright position upon movement of said target base from said upper position to said lower position.

2. The target apparatus of claim 1, wherein:

(a) said moving means includes an air cylinder for upward movement of said target base and spring means for downward movement of said target base; and (b) said control means includes a valve for controlling said air cylinder.

3. The target apparatus of claim 1, wherein said target is pivotally attached to the upper portion of said target base.

4. The target apparatus of claim 1, wherein said support frame is mounted in the ground.

5. The target apparatus of claim 4, wherein said target is exposed to a marksman when in its upright position and said target base is in its upper position.

6. The target apparatus of claim 1 wherein:

(a) movement of said target from said upright position to said knocked-down position therefor is effected by impact of a bullet with said target; and (b) the force of said bullet on said target required to move said target from said upright position to said knocked-down position is adjustable.

7. The target apparatus of claim 1, wherein said control means includes a magnetic reed switch, a computer, and an electrically actuated valve.

8. A target range, comprising:

(a) a plurality of target apparatus as defined in claim 1; and (b) programmable electronic computer means interconnected to each of said target apparatus for controlling said target apparatus.

* * * * *